US007395672B2

(12) United States Patent
Krause et al.

(10) Patent No.: US 7,395,672 B2
(45) Date of Patent: Jul. 8, 2008

(54) ICE DISPENSER ASSEMBLY AND METHOD OF ASSEMBLING SAME

(75) Inventors: Andrew Krause, LaGrange, KY (US); Ravi Varanasi, Andhra Pradesh (IN); Ramesh Janardhanam, Louisville, KY (US); Abdel Hamad, Prospect, KY (US)

(73) Assignee: General Electric Company, Schenectady, NY (US)

( * ) Notice: Subject to any disclaimer, the term of this patent is extended or adjusted under 35 U.S.C. 154(b) by 323 days.

(21) Appl. No.: 11/252,523

(22) Filed: Oct. 18, 2005

(65) Prior Publication Data

US 2007/0084230 A1 Apr. 19, 2007

(51) Int. Cl.
*F25C 5/02* (2006.01)

(52) U.S. Cl. ..... 62/66; 62/320; 241/DIG. 17

(58) Field of Classification Search ..... 62/320, 62/344, 66; 222/239–242, 412–413
See application file for complete search history.

(56) References Cited

U.S. PATENT DOCUMENTS

| | | | | |
|---|---|---|---|---|
| 4,619,380 | A * | 10/1986 | Brooks | 222/240 |
| 4,627,556 | A * | 12/1986 | Brooks | 222/240 |
| 4,972,999 | A | 11/1990 | Grace | |
| 5,056,688 | A | 10/1991 | Goetz et al. | |
| 6,010,037 | A | 1/2000 | Thompson | |
| 6,082,130 | A | 7/2000 | Pastryk et al. | |
| 6,904,765 | B2 * | 6/2005 | Lee et al. | 62/320 |
| 7,017,363 | B2 * | 3/2006 | Lee et al. | 62/320 |

* cited by examiner

*Primary Examiner*—William E Tapolcai
(74) *Attorney, Agent, or Firm*—George L. Rideout, Esq.; Armstrong Teasdale LLP

(57) ABSTRACT

An ice-dispenser assembly for a refrigerator includes a crusher, an auger, a motor configured to drive the auger, and a sorting device operatively coupled to the auger. The sorting device is configured to deliver ice to the crusher when rotated in a first direction and have ice bypass the crusher when rotated in the opposite direction.

20 Claims, 5 Drawing Sheets

ICE DISPENSER ASSEMBLY AND METHOD OF ASSEMBLING SAME

BACKGROUND OF THE INVENTION

This invention relates generally to refrigerators, and more particularly, to ice dispenser assemblies for a refrigerator and methods of assembling the same.

Through-the-door ice dispensers have been used in conventional household refrigerators for many years. Such dispensers typically include an external discharge opening formed on a door of the refrigerator convenient for a user to fill a glass with ice without opening the door. An ice bin is typically provided that receives and stores ice cubes from an ice maker. The ice is transferred to an opening in communication with a chute. The ice is transferred through the chute to the discharge opening. In order to move ice pieces to the opening and chute, a horizontal wire auger having a helically coiled portion is positioned lengthwise in the ice bin. The rear end of the wire auger is connected to a driving motor.

In at least some known ice dispensers, crushed ice may also be provided. In these known ice dispensers, a crusher is used to crush ice cubes before conveying them to the user's glass. A diverter door is typically provided to transfer the ice to the crusher. The diverter door is actuated by a solenoid assembly.

However, when the solenoid assembly is used, undesirable operating noises may be heard by the user. This provides an annoyance to the user. Additionally, a lag time in dispensing ice is experienced when the ice dispenser is changing between the crushed ice and cubed ice modes of dispensing. The crusher typically includes a set of stationary and a set of axially rotating blades or arms. Ice pieces are crushed by the crusher when the crusher is operated.

BRIEF DESCRIPTION OF THE INVENTION

In one aspect, an ice-dispenser assembly is provided for a refrigerator, wherein the ice-dispenser assembly includes a crusher, an auger, a motor configured to drive the auger, and a sorting device operatively coupled to the auger. The sorting device is configured to deliver ice to the crusher when rotated in a first direction and have ice bypass the crusher when rotated in the opposite direction.

In another aspect, an appliance is provided including a housing having a freezer compartment, an ice-bin positioned within the freezer compartment and configured to store ice cubes therein, a crusher in communication with the ice bin and configured to crush ice, and an ice dispenser assembly. The ice dispenser assembly includes a bi-directional helix device configured to deliver ice to the crusher when operated in a first direction and have ice bypass the crusher when operated in a second opposite direction.

In still another aspect, a method of assembling a refrigerator having a freezer compartment is provided. The method includes providing an ice bin configured to store ice cubes therein, providing a crusher in communication with the ice bin, wherein the crusher is configured to produce crushed ice cubes, and providing a dispenser in communication with the ice bin and the crusher, wherein the dispenser is configured to channel both cubed ice and crushed ice to a user. The method also includes arranging an ice dispenser assembly in communication with the ice bin and the crusher, wherein the ice dispenser assembly is configured to deliver ice cubes to the crusher when operated in a first direction and deliver ice cubes to the dispenser when operated in a second opposite direction such that the ice cubes bypasses the crusher.

DETAILED DESCRIPTION OF THE INVENTION

Figure 1:
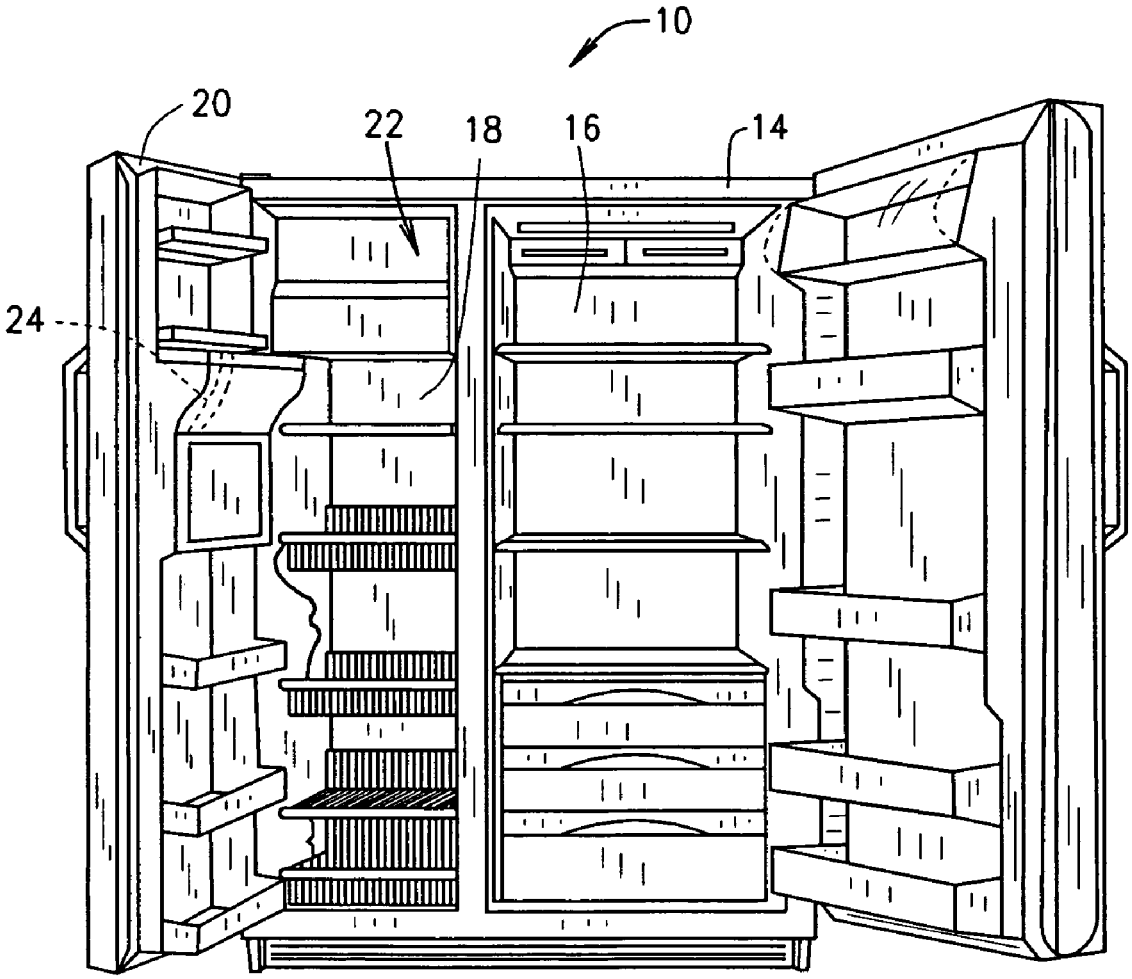
FIG. 1 illustrates a side-by-side refrigerator.

FIG. 1 is a perspective view of a side-by-side refrigerator 10 including an ice dispenser assembly 12. Refrigerator 10 typically includes a housing 14 which is normally formed by folding a sheet of a suitable material, such as pre-painted steel, into an inverted U-shape to form top and side walls of housing 14. Within housing 14 are a refrigerated compartment 16 and a freezer compartment 18 separated from each other by a vertical partition wall. At least one door 20 is hinged to an edge of housing 14 providing access to refrigerated compartment 16 and a freezer compartment 18. It is recognized, however, that the benefits of the present invention are equally applicable to other types of refrigerators, freezers, and refrigeration appliances. Consequently, the description set forth herein is for illustrative purposes only and is not intended to limit the invention in any aspect.

Ice dispenser assembly 12 includes a dispenser 22 having a discharge outlet (not shown) on an external portion of door 20 and a chute 24 formed within door 20 in communication with discharge outlet. Ice dispenser assembly 12 also includes an ice maker 26 configured to produce ice. Ice maker 26 is received in an ice bin 28 housed within freezer compartment 18. Ice bin 28 is configured to hold formed ice cubes therein until channeled to a user through dispenser 22. In one embodiment, chute 24 is in communication with ice-maker 26, such as, for example, through an opening (not shown) in ice bin 28. As a result, ice may pass from freezer compartment 18 to a user at the discharge outlet.

Figure 2:
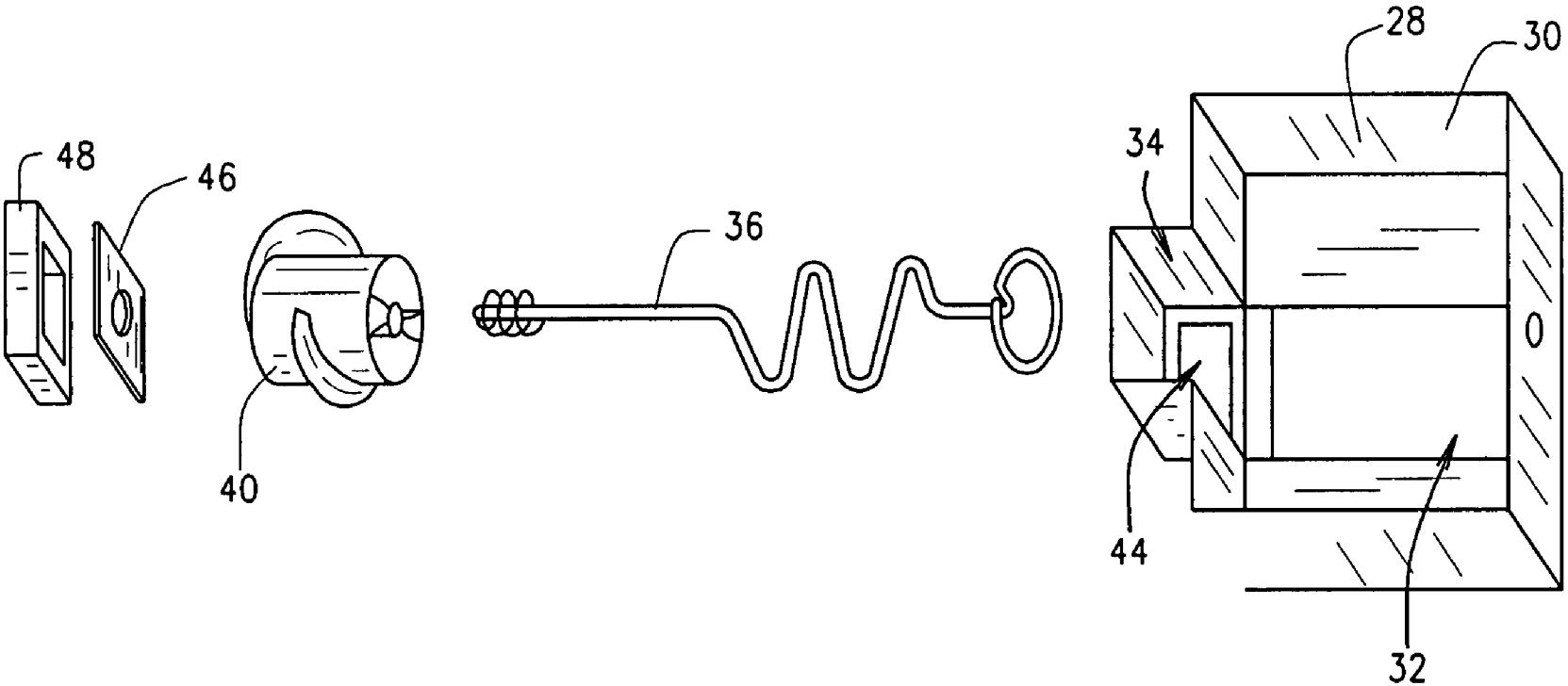
FIG. 2 is a partially broken away sectional view of a freezer compartment of the refrigerator shown in FIG. 1 including an ice dispenser assembly in accordance with one embodiment of the present invention.
Figure 3:
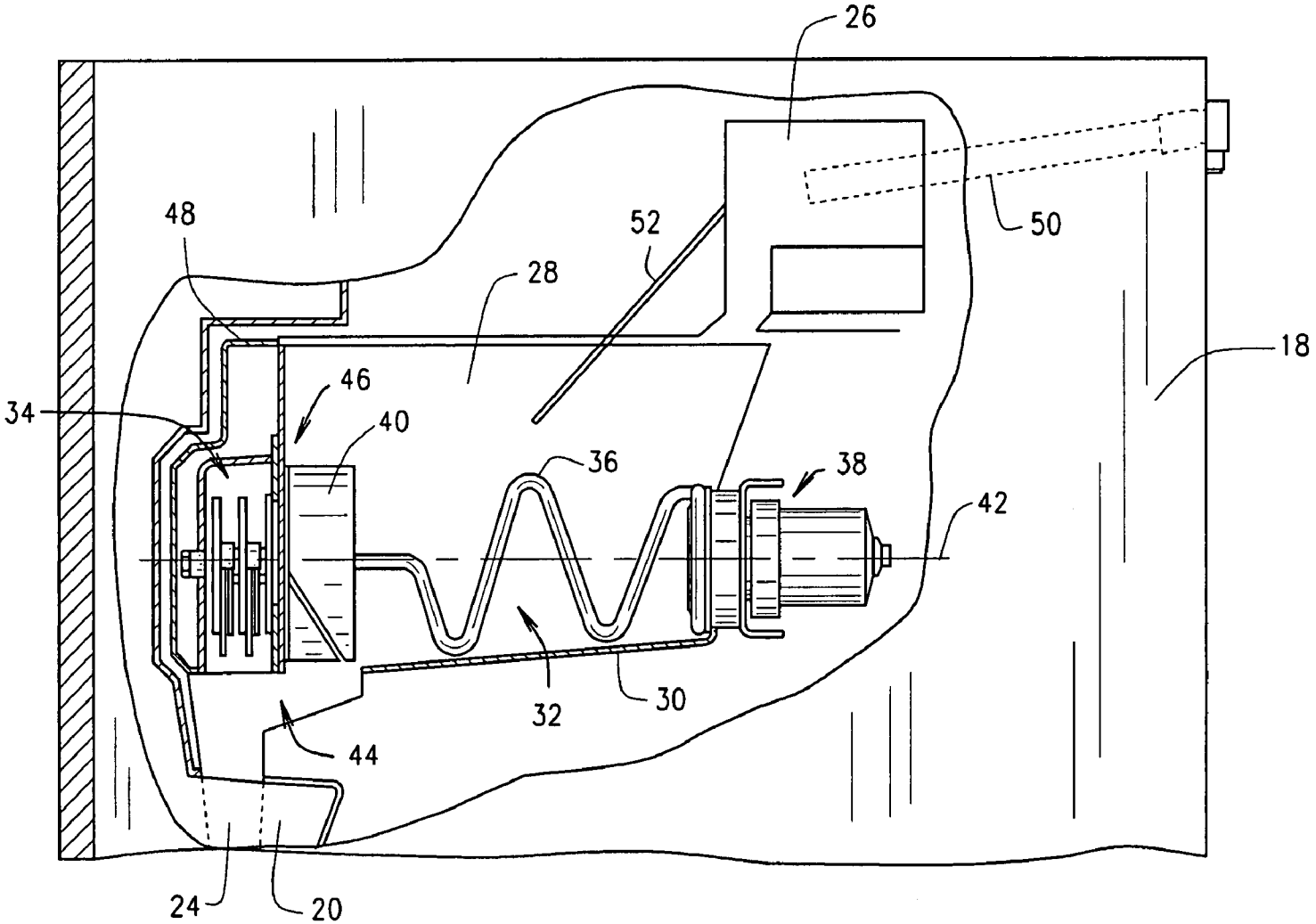
FIG. 3 is an exploded view of a portion of the ice dispenser assembly shown in FIG. 2.

FIG. 2 is a partially broken away sectional view of freezer compartment 18 including ice dispenser assembly 12, and FIG. 3 is an exploded view of a portion of ice dispenser assembly 12. In one embodiment, ice bin 28 includes an insulated body 30 and generally defines an ice feed section 32 and a crusher section 34. Feed section 32 includes an auger or agitator 36, a motor 38 connected to one end of auger 36 and configured to drive auger 36, and a sort helix device 40 connected to an opposing end of auger 36. In one embodiment, auger 36 and helix device 40 are positioned along a bottom of feed section 32 of ice bin 28. As such, auger 36 and helix device 40 contact the ice cubes stored in ice bin 28 during operation of ice dispenser assembly 12.

Auger 36 is shaped and oriented to transfer ice toward helix device 40 during operation of ice dispenser assembly 12. Motor 38 is, in one embodiment, a conventional reversible electric motor which rotates auger 36 about an axis of rotation 42 in both a clockwise and a counterclockwise direction, as illustrated by arrows A and B, respectively. Thus, depending on the drive direction of motor 38 selected by the user, auger 36 rotates in either a clockwise or counterclockwise direction. Helix device 40 is coupled to an end of auger 36 generally opposed to motor 38. As such, helix device 40 is moved in the same direction as auger 36 and is used to sort ice cubes depending on a direction of rotation of helix device 40.

Helix device 40 communicates with a dispensing section 44 of ice bin 28. In an exemplary embodiment, dispensing section 44 is positioned at a forward most position within ice bin 28 and is recessed with respect to feed section 32 of ice bin 28. Dispensing portion 44 of ice bin 28 is open to chute 24 such that ice may be transported from dispensing portion 44 through chute 24 to a user. In one embodiment, a door (not shown) blocks the opening from dispensing portion 44 to chute 24. Helix device 40 also communicates with crusher section 34. As such, ice cubes from ice bin 28 are transferred to crusher section 34 by helix device 40. In an exemplary embodiment, crusher section 34 includes an ice crusher 46 for crushing ice cubes into ice pieces and a housing 48 enclosing ice crusher 46. Crushed ice cubes are transferred from housing 48 to dispensing portion 44.

As illustrated in FIG. 3, ice maker 26 is open to ice bin 28. In operation, a water tube 50 supplies water to ice maker 26 for making ice cubes, and a sensor arm 52 senses the amount of ice within ice bin 28. When sensor arm 52 senses an ice cube level below a predetermined level, water is delivered to ice maker 26 to produce ice cubes and deliver them to ice bin 28.

Figure 4:
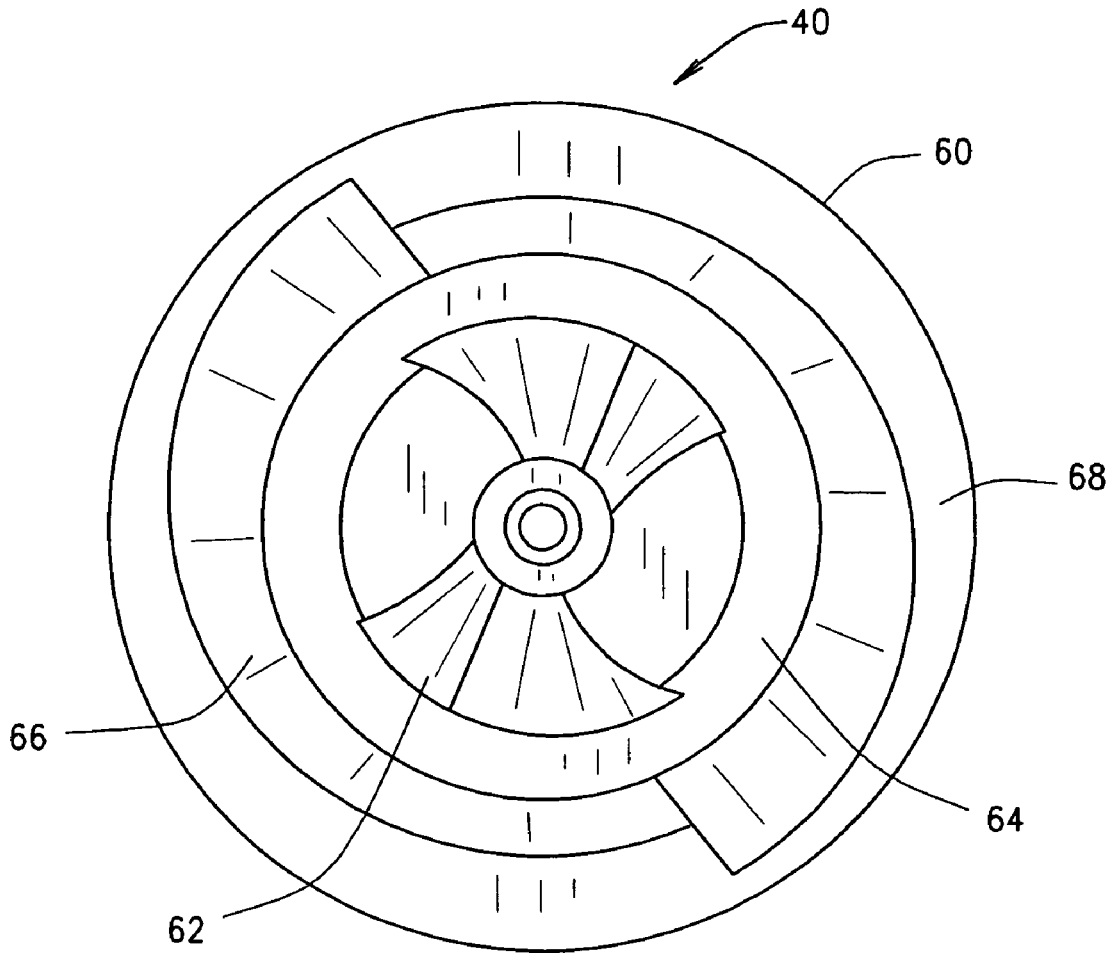
FIG. 4 is a front view of a portion of the ice dispenser assembly shown in FIG. 2.

FIG. 4 is a front view of helix device 40. Helix device 40 is enclosed in a cylindric chamber 60 to contain ice cubes within helix device 40. Helix device 40 comprises a plurality of inner blades 62 pitched in a first direction in a central portion 64 of helix device 40 to form a first helix. Central portion 64 extends between and communicates with ice bin 28 and crusher section 34. Crusher section 34 communicates with housing 48, and more particularly, with an opening (not shown) in housing 48. The opening in housing communicates with dispensing portion 44 and chute 24 such that crushed ice from crusher section 34 may be delivered to the user. Ice cubes are transferred through central portion 64 by inner blades 62. Helix device 40 also includes a plurality of outer blades 66 pitched in a second opposite direction on an exterior portion 68 of helix device 40 to form a second helix. Exterior portion 68 extends between and communicates with ice bin 28 and dispensing portion 44, and more particularly, with an opening (not shown) in dispensing portion 44. The opening in housing communicates with chute 24 such that ice from ice bin 28 may be delivered to the user. In use, the angular orientation and pitch of blades 62 and 66, in combination with the rotational movement of helix device 40 determine which portion 64 or 68 the ice cubes are transferred through. Specifically, clockwise movement of helix device 40 causes ice cubes to move forward in central portion 64 and backwards in exterior portion 68. Alternatively, counter-clockwise movement of helix device 40 causes ice cubes to move forward in exterior portion 68 and backwards in central portion 64.

A center body 70 extends axially through helix device 40 and separates central portion 64 of the first helix from exterior portion 68 of the second helix. Specifically, inner blades 62 extend inward from center body 70, and outer blades 66 extend outward from center body 70. Center body 70 extends the length of helix device 40.

Figure 5:
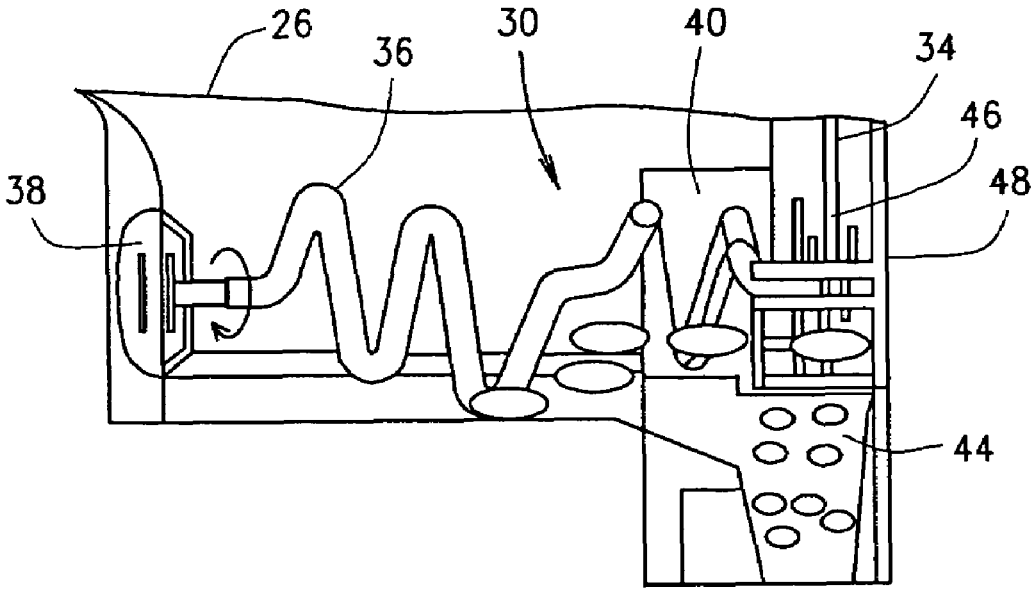
FIG. 5 is a cross sectional view of the ice dispenser assembly shown in FIG. 2 operating in a first mode of operation.
Figure 6:
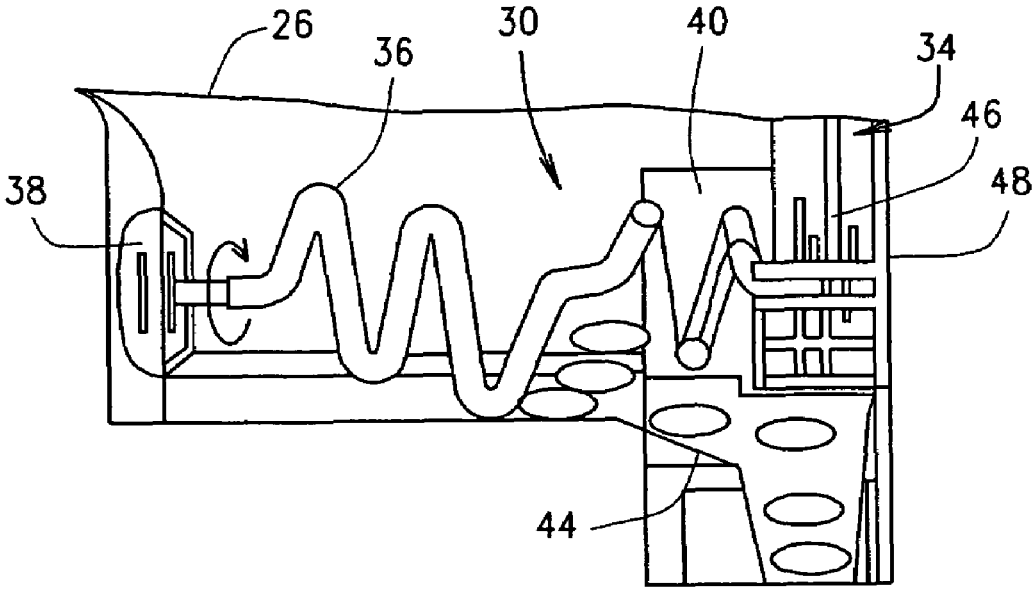
FIG. 6 is cross sectional view of the ice dispenser assembly shown in FIG. 2 operating in a second mode of operation.

FIGS. 5 and 6 are cross sectional views of ice dispenser 22 shown in FIG. 3. FIG. 5 illustrates a crushed ice dispensing mode of operation of ice dispenser assembly 12 with motor 38 and auger 36 rotating in the clockwise direction. FIG. 6 illustrates a cubed ice dispensing mode of operation of ice dispenser assembly 12 with motor 38 and auger 36 rotating in the counterclockwise direction.

In operation, a user uses ice dispenser assembly 12 to receive either cubed or crushed ice. Specifically, a user demands ice, such as by depressing a paddle (not shown) on an exterior of refrigerator 10. When demanded, ice cubes are transferred by auger 36 within ice bin 28 toward helix device 40. In an exemplary embodiment, auger 36 transfers ice cubes toward helix device 40 when auger 36 is rotated in either the clockwise or the counter-clockwise direction. Additionally, as auger 36 is rotated, helix device 40 is rotated. As the ice cubes interface with helix device 40, the ice cubes are either directed into central portion 64 of helix device 40 or exterior portion 68 of helix device 40. In an exemplary embodiment, ice cubes directed into exterior portion 68 of helix device 40 are directed into a bypass passage 72 which bypasses central portion 64 and ice crusher 46.

In the exemplary embodiment, and as illustrated in FIG. 5, when a user selects crushed ice, the helix device 40 is rotated in the clockwise direction. Ice cubes are transferred through central portion 64 to ice crusher 46. Specifically, the angular orientation in combination with the rotational movement of inner blades 62 force the ice cubes through central portion 64. Additionally, when the helix device 40 is rotated in the clockwise direction, the angular orientation and rotational movement of outer blades 66 restrict passage of the ice cubes through exterior portion 68. The crushed ice cubes are then delivered through housing 48 to dispensing portion 44, chute 24 and ultimately to the user.

In the exemplary embodiment, and as illustrated in FIG. 6, when a user selects cubed ice, the helix device 40 is rotated in the counter-clockwise direction. Ice cubes bypass central portion 64 and are transferred through exterior portion 68 to dispensing portion 44. Specifically, the angular orientation in combination with the rotational movement of outer blades 66 force the ice cubes through exterior portion 68. Additionally, when the helix device 40 is rotated in the counter-clockwise direction, the angular orientation and rotational movement of inner blades 62 restrict passage of the ice cubes into interior portion 64. The ice cubes are then delivered through dispensing portion 44 to chute 24 and ultimately to the user.

An ice dispenser assembly is provided which provides cubed ice and crushed ice in a cost effective and reliable manner. Manufacturing and assembling cost of the ice dispenser assembly are reduced due to a reduced component number and cost, since some convention components, such as solenoids, are eliminated. In addition, operational noise of the ice dispenser assembly is minimized, since some convention components, such as solenoids, are eliminated.

Exemplary embodiments of ice dispenser assemblies are described above in detail. Each assembly is not limited to the specific embodiments described herein, but rather each component may be utilized independently and separately from other components described herein. Each component can also be used in combination with other ice dispenser assemblies.

While the invention has been described in terms of various specific embodiments, those skilled in the art will recognize that the invention can be practiced with modification within the spirit and scope of the claims.

What is claimed is:

1. An ice-dispenser assembly for a refrigerator, said ice-dispenser assembly comprising:

a crusher positioned within a housing;

an auger;

a motor configured to drive said auger; and a sorting device operatively coupled to said auger, wherein said sorting device is configured to deliver ice to said crusher within said housing when rotated in a first direction and to direct ice into a passage configured to bypass said housing when rotated in an opposite second direction.

2. An ice-dispenser assembly in accordance with claim 1 wherein said sorting device comprises a first plurality of blades pitched in a first direction on a central portion thereof and a second plurality of blades pitched in a second direction on an exterior portion thereof, the first pitch direction different than the second pitch direction.

3. An ice-dispenser assembly in accordance with claim 1 further comprising a receptacle arranged below said crusher, wherein said sorting device comprises an inside helix configured to deliver ice to said crusher within said housing and an outside helix configured to direct ice to bypass said housing such that the ice is delivered to said receptacle uncrushed.

4. An ice-dispenser assembly in accordance with claim 1 further comprising a dispenser body defining an upper opening in communication with said crusher and a lower opening arranged below said helix device.

5. An ice-dispenser assembly in accordance with claim 1 wherein said sorting device comprises a center body extending therethrough, said center body separating said sorting device into a center portion and an exterior portion.

6. An ice-dispenser assembly in accordance with claim 5 wherein said sorting device comprises inner blades located within said center portion and extending inward from said center body and outer blades located within said exterior portion and extending outward from said center body, said inner blades having a different angular orientation than said outer blades such that rotation of said sorting device causes ice to move in a first direction within said center portion and a second direction within said exterior portion.

7. An appliance comprising:

a housing comprising a freezer compartment;

an ice-bin positioned within said freezer compartment and configured to store ice therein;

a crusher in communication with said ice bin and configured to crush ice, said crusher positioned within a crusher housing; and an ice dispenser assembly comprising a bi-directional helix device configured to deliver ice to said crusher within said crusher housing when operated in a first direction and to direct ice into a passage configured to bypass said crusher housing when operated in an opposite second direction.

8. An appliance in accordance with claim 7 wherein said ice dispenser assembly comprises an auger and a motor configured to drive said auger, said helix device operatively coupled to said auger.

9. An appliance in accordance with claim 7 wherein said helix device comprises a first plurality of blades pitched in a first direction on a central portion thereof and a second plurality of blades pitched in a second direction on an exterior portion thereof, the first pitch direction different than the second pitch direction.

10. An appliance in accordance with claim 7 further comprising a receptacle arranged below said crusher, wherein said helix device comprises an inside helix configured to deliver ice to said crusher within said crusher housing and an outside helix configured to direct ice to bypass said crusher housing such that the ice is delivered to said receptacle uncrushed.

11. An appliance in accordance with claim 7 wherein said helix comprises an inside helix pitched in a first direction on a central portion thereof and configured to deliver ice to said crusher within said crusher housing; and an outside helix pitched in a second direction on an exterior portion thereof and con figured to deliver ice outside of said crusher housing, the first pitch direction different than the second pitch direction.

12. An appliance in accordance with claim 7 wherein said helix device comprises a center body extending therethrough, said centerbody separating said helix device into a center portion and an exterior portion.

13. An appliance in accordance with claim 12 wherein said helix device comprises inner blades located within said center portion and extending inward from said center body and outer blades located within said exterior portion and extending outward from said center body, said inner blades having a different angular orientation than said outer blades such that rotation of said helix device causes ice to move in a first direction within said center portion and a second direction within said exterior portion.

14. A method of assembling a refrigerator having a freezer compartment, said method comprising:

providing an ice bin configured to store ice therein;

providing a crusher in communication with the ice bin, wherein the crusher is positioned within a housing, and configured to produce crushed ice;

providing a dispenser in communication with the ice bin and the housing, wherein the dispenser is configured to channel ice to a user; and arranging an ice dispenser assembly in communication with the ice bin and the housing, wherein the ice dispenser assembly is configured to deliver ice to the crusher within the housing when operated in a first direction and to direct ice into a passage configured to bypass the housing when operated in an opposite second direction such that ice is delivered to the dispenser.

15. A method in accordance with claim 14 wherein arranging an ice dispenser assembly comprises:

coupling an auger to a reversible motor configured to drive the auger; and coupling a helix device to the auger, wherein the helix device is configured to deliver ice to the crusher within the housing when operated in one direction and to direct ice into a passage configured to bypass the housing when operated in the opposite direction such that ice is delivered to the dispenser.

16. A method in accordance with claim 15 wherein coupling a helix device to the auger comprises providing a first plurality of blades pitched in a first direction on a central portion of the helix device and a second plurality of blades pitched in a second direction on an exterior portion of the helix device, the first pitch direction different than the second pitch direction.

17. A method in accordance with claim 15 further comprising providing a bypass passage between the ice bin and the dispenser, wherein the ice dispenser assembly is configured to channel uncrushed ice through the bypass passage to the dispenser when operated in a first mode of operation.

18. A method in accordance with claim 15 further comprising forming an inside helix pitched in a first direction in a central portion of the helix device and forming an outside helix pitched in a second direction on an exterior portion of the helix device, the first pitch direction different than the second pitch direction.

19. A method in accordance with claim 15 wherein said coupling a helix device to the auger comprises coupling a helix device having a center body extending therethrough, wherein the center body separates the helix device into a center portion and an exterior portion.

20. A method in accordance with claim 19 wherein said coupling a helix device having a center body comprises:

coupling inner blades within the center portion wherein the inner blades extend inward from the center body, and wherein the inner blades have an angular orientation; and coupling outer blades within the exterior portion wherein the outer blades extend outward from the center body, and wherein the outer blades have an angular orientation different than the angular orientation of the inner blades such that rotation of the helix device causes ice to move in a first direction within the center portion and a second direction within the exterior portion.

* * * * *

UNITED STATES PATENT AND TRADEMARK OFFICE

CERTIFICATE OF CORRECTION

PATENT NO. : 7,395,672 B2
APPLICATION NO. : 11/252523
DATED : July 8, 2008
INVENTOR(S) : Krause et al.

It is certified that error appears in the above-identified patent and that said Letters Patent is hereby corrected as shown below:

In Claim 11, column 6, line 1, delete “con figured” and insert therefor -- configured --.

Signed and Sealed this

Ninth Day of June, 2009

JOHN DOLL
*Acting Director of the United States Patent and Trademark Office*